US005516315A

United States Patent [19]

Griffin

[11] Patent Number: 5,516,315

[45] Date of Patent: May 14, 1996

[54] DRIVESHAFT HOUSING APPARATUS

[76] Inventor: Clarence A. Griffin, 11740 Immokalee Rd., Naples, Fla. 33964

[21] Appl. No.: 427,749

[22] Filed: Apr. 24, 1995

[51] Int. Cl.[6] ..... B63H 1/18

[52] U.S. Cl. ..... 440/66; 114/274

[58] Field of Search ..... 440/66, 68, 69, 440/70, 71, 72, 900; 114/271, 274

[56] References Cited

U.S. PATENT DOCUMENTS

| | | | |
|---|---|---|---|
| 2,319,640 | 5/1943 | Sink | 440/71 |
| 2,717,570 | 9/1955 | Willoughby | 440/71 |
| 4,565,533 | 1/1986 | Springer | 440/71 |
| 5,207,605 | 5/1993 | Kroeber | 440/71 |
| 5,344,346 | 6/1994 | Griffin | 440/66 |

*Primary Examiner*—Stephen Avila

*Attorney, Agent, or Firm*—Myron E. Click

[57] ABSTRACT

Apparatus for further improving the efficiency of a propulsion unit having a driveshaft depending from the stern of a boat, while protecting flora and fauna in the water as well as the propulsion unit. A plate member has an upper end adapted to be positioned forward of a driveshaft housing, and to depend downwardly and rearwardly to terminate in a trailing lower end below a propeller. The plate member tapers outwardly along lateral edges from the upper end to the lower end to divert flora and fauna around and under a housing and a propeller attached thereto. A lower portion of the plate member is divided into a plurality of spaced plate-like components defining passageways therebetween to enable water to flow therethrough for more efficient operation of a propeller. At the same time, the forward surfaces of the plate-like components react with passage of water when under way to urge a boat's stern upwardly to a more efficient hull operating position.

20 Claims, 3 Drawing Sheets

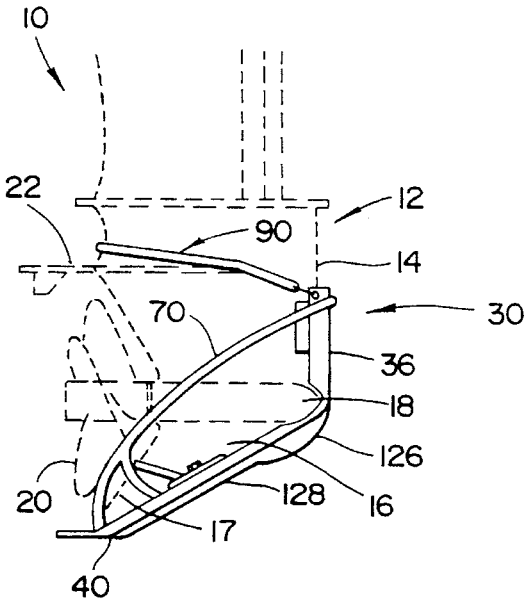
Fig- 2
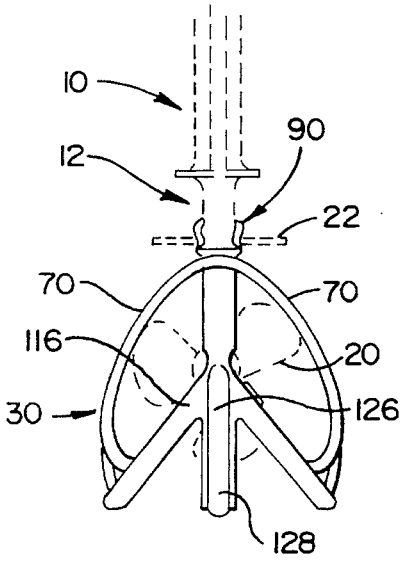
Fig- 3
Fig- 5
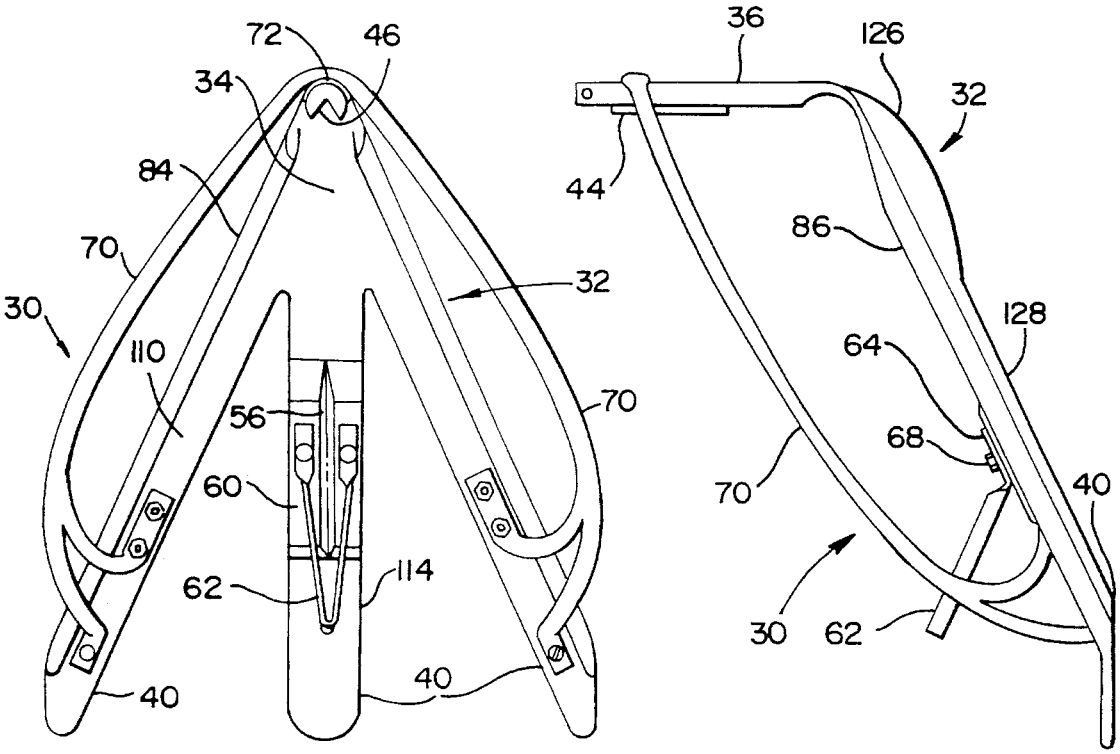
Fig- 4

DRIVESHAFT HOUSING APPARATUS

BACKGROUND OF THE INVENTION

1. Field of the Invention

This invention relates to apparatus for driveshaft housings for boat engines or propulsion units generally and, in particular, for driveshaft housings connecting boat engines such as outboard, inboard-outboard and the like to the propeller. The apparatus is designed to protect humans, manatees, sea grass and the like in the water from the propeller, fins, and other parts of the housing, while also protecting the propeller, the fins and the like, and improving the efficiency of operation. This apparatus may be permanently or removably secured to such propulsion units.

This invention is an improvement upon the apparatus disclosed in applicant's U.S. Pat. No. 5,344,346, issued Sep. 6, 1994, and the disclosure, background and discussion of the prior art therein is incorporated herein by reference thereto.

2. Description of the Prior Art

The prior art has many examples of devices for protecting the propeller and submerged boat propulsion parts. However, these devices do not protect creatures in the water very well. Further, the prior art devices reduce the efficiency of the propulsion units by adding undesirable drag loads. Some of the prior art attachments are removable, which could reduce the drag load after reaching open water, but are really removable only when the boat is essentially in a dock or dry dock situation. Those that could be removed when the boat is under way or in open waters may lose attaching parts and/or are not as stable as desired to reduce vibration problems.

U.S. Pat. Nos. 1,009,635; U.S. Pat. No. 1,869,977; Re. 18,602; U.S. Pat. No. 2,054,374; U.S. Pat. No. 2,140,099; U.S. Pat. No. 2,355,842; U.S. Pat. No. 2,963,000; U.S. Pat. No. 2,985,133; U.S. Pat. No. 3,965,845 and U.S. Pat. No. 4,096,819 are examples of propeller guards that are essentially permanently attached in that they cannot be readily removed when the boat is under way or in open water. Removability is very desirable, because such guards are added drag loads.

Further, none of the devices protect creatures in the water very well. That is, fins or tines are spaced so far apart that arms, hands, fingers, fins, etc. can go between them and be damaged by the propeller. In some, the circle scribed by the propeller radius extends outside of the protection zone of the guard. In others, a keel-like support portion can do substantial impact damage to a swimming creature. Moreover, in some designs, the skeg or gear housing or other parts are forward of the protective zone and can do substantial impact damage. Finally, there are many sharp edges that are harmful, whether designed for cutting weeds or just sharp by the nature of their design.

U.S. Pat. No. 2,470,874 discloses a propeller guard that can be pivoted up out of the water. However, the fork arms provide no protection for swimmers and, in fact, are hazardous themselves because the fork arms have knife-like forward edges.

U.S. Pat. No. 2,972,977 discloses a propeller guard which affords more protection than some of the devices because an object engaging shoe is held behind and below the propeller by a pair of spaced, vertical support arms that are pivotally mounted on the transom. A push block carried about halfway down on the support arms pushes against the forward part of upper housing 16 to pivot the propeller and housing out of the water when the shoe strikes an object under the water.

However, the solid shoe adds a very substantial drag load that reduces the efficiency of the propulsion unit. While the device might be removed if the boat were dead in the water, it is very difficult because, after removal of the mounting from the transom, the unit must be lowered much further into the water so that the push block can be passed below the skeg. If the motor is running and the propeller is turning, removal is very dangerous because either one of the support arms or the push block may strike and damage the propeller. Thus, the outboard motor attachment is essentially permanently mounted because the boat must be either in dry-dock, or docked with the engine not running, for safe removal.

The shoe might have been designed to assist the boat in planing, either at full speed or at lower speeds in regulated waters. However, not only is there no teaching or suggestion that such was intended, but the upper part 52 of the shoe 50 has a reduced width to space the support arms apart. In addition, upper part 52 is angled toward the rear, so that when the boat is under way water passing over part 52 actually pushes the part 52 downwardly to interfere with any planing effort.

U.S. Pat. No. 2,319,640 discloses a propeller guard which provides a better protection zone than most. However, the blade-like fingers can cut and injure creatures in the water. Further, while the inventor states that his device reduces turbulence, there is still a substantial amount of drag load and turbulence and therefore less efficiency at slower speeds. Therefore it would be very desirable to be able to remove the device under way and in open water at higher speeds.

However, the guard is attached under the water line to the cavitation plate by a wing nut to a plate bolt. The device is subject to nut loosening and loss of the device as a result of the vibration of the blade-like fingers. To detach the guard, one has to work under water with the possibility of loss of the wing nut and/or guard. Moreover, the nut/bolt combination may corrode, resisting or preventing removal without tools. Thus, this propeller guard is again essentially a permanently mounted device which hampers efficiency at all speeds.

U.S. Pat. No. 4,565,533 discloses a propeller guard which does not provide adequate protection for swimmers, manatees, etc. because the rearwardly extending ribs are much too far apart. However, it does disclose a quick-release system to enable removal under way or in open water to improve propulsion efficiency at higher speeds when swimmers, manatees are not in, or not supposed to be in, the water. While a safety loop 46 on the main body is provided for attachment to a safety line to prevent loss by dropping the guard, the other essential part 44 of the attaching system does not have any means for preventing loss of the part. This is a major flaw since the boat may have to return through swimmer and manatee waters without protection for them.

This device has a further problem in that the ribs are going to vibrate, affecting the stability of the device and increasing turbulence. While a sleeve 38 is provided to receive the skeg, there is a substantial length of the main rib 25 between the skeg and a quick-release that isn't anchored in any way.

The structure of U.S. Pat. No. 4,565,533 includes a vertical main rib with a plurality of widely spaced side ribs extending laterally outwardly from the main rib and then substantially horizontally backwards to form an open cage around the propeller. The vertical and horizontal ribs cannot materially assist in urging a boat's stern upwardly to a more efficient operating position. Moreover, there is no suggestion or teaching in this patent regarding lifting a boat's stern. The three lower ribs 30, 30 and 32 are formed from resilient steel to provide shock absorbing functions. Thus, neither the function of protection of swimmers, etc. or the structure of applicant's invention is shown or taught.

U.S. Pat. No. 4,680,017 discloses a propeller guard that isn't satisfactory because of the large drag load, the damage that the sharp edges of ribs 58 can do to swimming creatures, and the inability to easily remove or reinstall the guard in open water or while under way—with the added possibility that the guard may be dropped in the water and lost. However, the device does show a frame member 52 which is channel shaped to extend around leading edge 18 of lower housing 16. This provides structural support for the ribs 58 and protects leading edge 18 and skeg 22 from damage. On the other hand, because water is flowing directly past frame 58 between ribs 58, there is no deflection of a swimmer or a manatee by a diverted water flow, and impact against the frame 58/edge 18 is direct and damaging.

U.S. Pat. No. 5,207,605 was cited during the prosecution of applicant's above-referenced U.S. Pat. No. 5,344,346 as teaching a tapered plate member. Kroeber was distinguished from that invention by noting that there was no disclosure in Kroeber of a plate member depending downwardly and rearwardly from a position forward of a gearshaft housing to divert swimmers, etc. around and under a housing and propeller.

The function of a propeller is to produce thrust along the axis of the propeller shaft to drive the boat or ship, by giving momentum to the water it displaces in an astern direction. In pushing the water backwards, a reaction force is developed to push the craft forward. It is therefore desirable to maintain the axis of the propeller substantially parallel to the horizontal axis of the craft when the hull is in its most efficient operating position in the water. Most craft that will be using this invention will have planing type hulls, as opposed to displacement hulls. The planing type hull operates most efficiently when the stern of the boat is raised by the speed of the boat in open waters.

As noted above, the prior art devices of this general type add drag load when used. Further, most of them cause substantial turbulence which further reduces the efficiency of the propeller. None of them react with the water passage to lift the stern of the boat to a more efficient operating position.

Applicant's previous invention in the above-referenced U.S. Pat. No. 5,344,346 solved the problems of protecting swimmers, sea grass, manatees, and other objects in the water by providing apparatus which was readily removed and reattached. Since it probably would be primarily used in speed restricted waters, and then removed in open water, it has worked very well.

However, in many coastal waters, there can be a series of alternately occurring open waters and speed restricted waters. Thus, to get a better efficiency in open waters many boaters may remove and reattach applicant's previous apparatus a number of times. It became apparent that an improved apparatus which provided improved efficiency in open water without removal would be very useful.

Accordingly, it is an object of this invention to provide apparatus which protects swimmers, sea grass, manatees and other objects in the water, while improving efficiency of propeller and boat hull operation.

It is another object of this invention to provide the improved apparatus just discussed while still providing protection for the propulsion units themselves.

It is a further object of this invention to provide such improved apparatus which is designed to improve the efficiency of the propulsion unit by admitting more water directly to the propeller area, while still providing lift to the stern of a boat to reduce the effect of any drag load.

A still further object of this invention is to provide such improved apparatus which may be removably or permanently secured to a propulsion unit.

Another object of this invention is to provide such improved apparatus which may be left in place at all times without appreciably affecting the performance of a boat.

SUMMARY OF THE INVENTION

Apparatus which further improves the efficiency of a propulsion unit, while protecting flora and fauna in the water as well as the propulsion unit. A plate member has an upper end adapted to be positioned forward of a housing and to depend downwardly and rearwardly to terminate in a trailing lower end. The plate member tapers outwardly along lateral edges from the upper end to said lower end to divert flora and fauna in the water around and under a housing and propeller. The downward and rearward configuration of the plate member reacts to the passage of water when under way to urge a boat's stern upwardly to a more efficient operating position.

It is desirable to admit more water directly to the propeller area to improve propeller efficiency, while still using the uplifting properties of the plate member to improve boat hull efficiency. This may be accomplished in two different ways.

The first way to accomplish the just-mentioned objectives is to form aperture means in the plate member for defining a plurality of separate plate-like components. The aperture means permits passage of water therethrough directly to the propeller area, while the plate-like components urge a boat's stern upwardly. The separate plate-like components may include a pair of outer components depending from an upper portion of the plate member. The outer pair have the tapered lateral edges formed thereon.

The lower ends of the outer pair of plate-like components may have means for connecting them to the upper end of the plate member to strengthen the components. The connecting means may be curved outwardly from the upper end to define a protection zone whereby swimmer's body parts and other objects are diverted away from a propeller.

The aperture means may include at least two apertures to define a third plate-like component depending from the upper portion of the plate member intermediate the pair of outer components. Means can be provided for cooperating with a skeg and the third plate-like component for maintaining the plate member in alignment with a driveshaft housing.

The apertures are preferably elongated openings extending upwardly and forwardly from the trailing lower end of the plate member. The openings may be closed by the plate member at the trailing lower end, thereby deflecting swimmers, objects, sea grass and the like from entry into the openings and contract with a propeller. The portion of the plate member that closes the openings may have a surface formed to assist in urging a boat's stern upwardly.

The openings may be left open at the trailing end to define a plurality of separated plate-like components depending from an upper portion of the plate member. In order to prevent entry of swimmers, objects, sea grass and the like between the plate-like components and possible contact with a propeller, means may be extended between lower ends of the components. Such extended means may be a wire, cable, coated cable or other elements depending upon the environment in which the apparatus is operating.

The second way to accomplish the objectives set forth above is to divide a lower portion of the plate member into a plurality of spaced plate-like components defining passageways therebetween to enable water to flow therethrough, for more efficient operation of a propeller while said plate-like components assist in urging a boat's stern upwardly.

As in the first way above, the spaced components may include a pair of outer components depending from an upper portion of the plate member, those components having the tapered lateral edges formed thereon. A third plate-like component may depend from the upper portion of the plate member between the pair of outer components.

Again, as in the first way above, the third component may be positioned to provide alignment of the plate member in cooperation with a skeg of a driveshaft housing. The third component may have a configuration for receiving a skeg to maintain the third component and thus the plate member in alignment with a driveshaft housing. An inverted "V" member may be provided for engaging a trailing surface of a skeg to retain a forward surface of a skeg in the skeg receiving configuration. The "V" member may be adjustably secured to the third component for movement to accommodate skegs of different driveshaft housings.

In both approaches, a rib means may be formed on a forward side of the third component and extending threrealong for reinforcing the third component. Further, the tapered lateral edges on the outer components may be rounded to remove cutting surfaces. And means may be extended between the lower ends of the plate-like components for deflecting objects from entry between the plate-like components.

BRIEF DESCRIPTION OF THE DRAWINGS

In the drawings, where like numerals are employed to designate like parts throughout:

FIGS. 2 and 3 are side and front elevational views of the apparatus of this invention attached to an outboard motor with which this invention may be utilized;

FIGS. 4 and 5 are top and side elevational views of the first embodiment of this invention.

DESCRIPTION OF PREFERRED EMBODIMENTS

Figure 1:
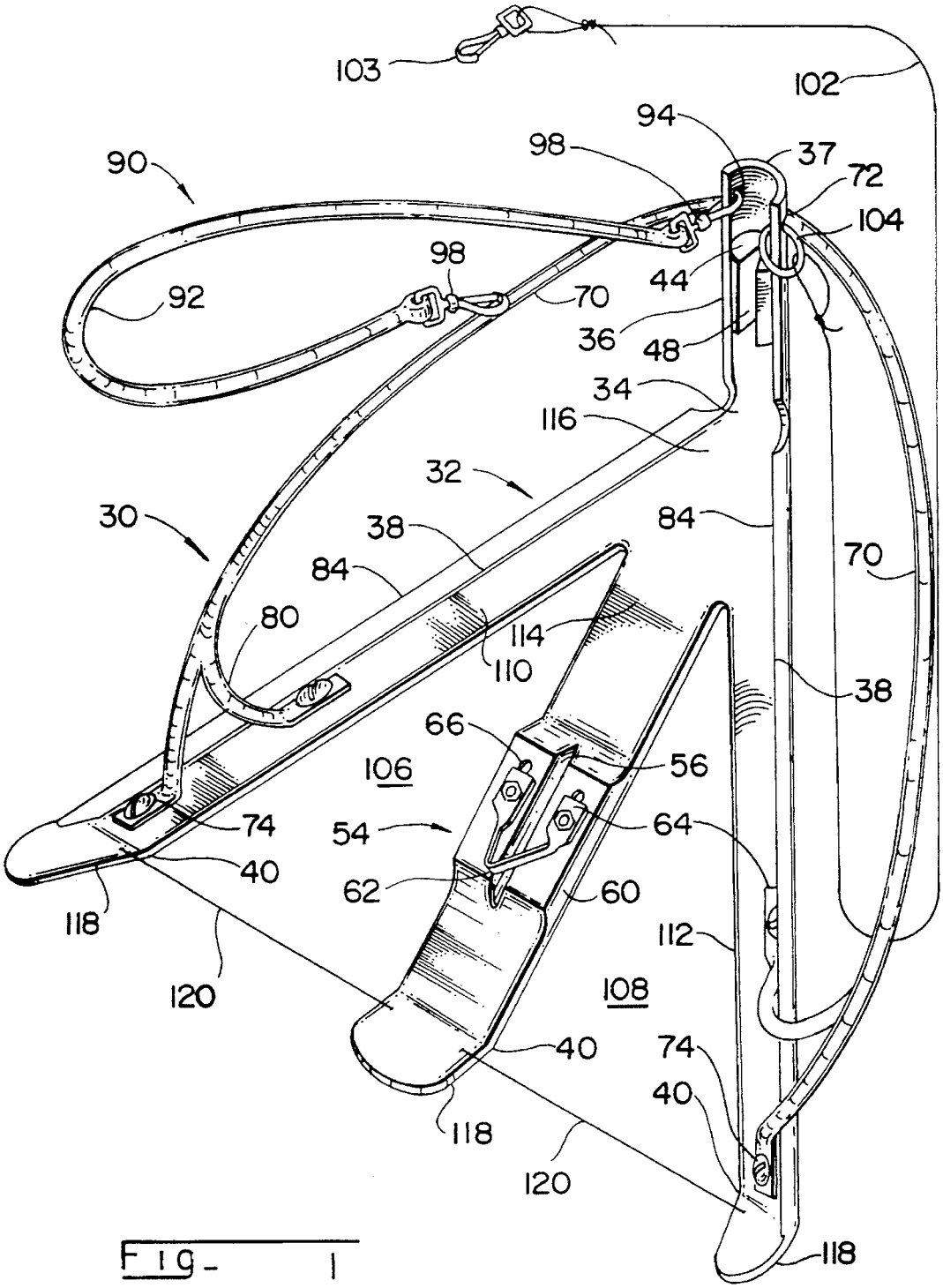
FIG. 1 is a view of perspective of a first embodiment of the apparatus of this invention.

Referring now to FIGS. 1 through 5 there is illustrated a first embodiment. FIGS. 2 and 3 show the invention as it appears with an outboard motor or propulsion unit, which is generally indicated at 10, suspended from the transom of a boat. A driveshaft housing indicated generally at 12 has an upper portion 14 of the housing's leading edge and a lower portion 16 of the leading edge. The lower portion of the housing is usually referred to as the skeg and has a trailing edge 17 at the lower tip of the skeg. A propeller gear housing 18 has a shaft extending rearwardly therefrom to carry a propeller 20. A cavitation plate 22 is shown on the upper part of the housing.

The propulsion unit 10 is shown in phantom lines in a generic form merely to illustrate the connection of an attachment indicated generally at 30, and the arrangement of the component parts of an attachment with respect to propulsion unit parts shown in the drawing.

The attachment 30 has a plate member 32, which has an upper end 34 to be positioned forward of housing 12 (best seen in FIG. 2), and to depend downwardly and rearwardly to terminate in a lower trailing edge or end 40. The plate member 32 tapers outwardly along lateral edges 38 from the upper end 34 to the lower end 40 to divert swimmers and other objects around and under the housing 12 and propeller 20.

The trailing end 40 preferably extends at least to the vertical plane defined by the end of the propeller hub for two reasons. First, it is desired to prevent injury in the protection zone between the trailing end 40 and the forward part of housing 12. Secondly, this enables the lower face of plate 32 to have a larger surface to react with the passage of water when under way to urge a boat stern upwardly toward a more efficient planing position, even at relatively slower boat speeds.

A resilient means 44 connected to the upper end 36 of plate 32 is provided for receiving the leading edge of the upper portion 14 of housing 12. The means 44 has a V-shaped configuration 48 which maintains the upper end 34 aligned with the driveshaft housing, and which also reduces or eliminates vibration of the apparatus 30 in that area. The means 44 provides surfaces 46 to the rear of upper end 36 for engaging the sides of the housing 12 to the rear of the leading edge to prevent lateral movement of upper end 34.

In this first embodiment the above is accomplished by including an upward extension or spine portion 36 as part of upper end 34, the spine 36 extending upwardly in substantially vertical alignment with the leading edge of the upper portion 14 of the housing 12.

Similarly, a means generally indicated at 54 is carried on and connected to the lower end of plate 32 on a plate-component 114 above the trailing edge or end 40 receiving the leading or forward edge of the skeg or the lower portion 16 of housing 12. The means 54 has a groove configuration 56 which maintains the lower end or leading edge in lateral alignment with the axis of housing 12, and which reduces or eliminates vibration of the attachment 30 in that area. The means 54 provides a V-shaped surface 56 to the rear of plate 32 for engaging the sides of the skeg 16 to the rear of the leading edge of the skeg to prevent lateral movement of the trailing end 40.

Finally, the skeg receiving means 54 includes means for engaging both a forward or leading surface and a trailing surface of the skeg 16 at the tip 17 to secure the skeg in a fixed position with respect to the plate member 32, both vertically and laterally.

An inverted "V" 62 has feet or attachment pads 64 with holes formed therein to receive bolts 68 which secure the pads 64 to the plate component 114 by insertion into slot-like bores 66 formed in pads 64 or in a saddle 60 formed on component 114. The slot-like bores 66 enable adjustably securing of the "V" in different positions to accommodate different sizes and shapes of skegs.

These skeg receiving means not only stabilize the apparatus 30, but also acts as guides, and assists in mounting the attachment 30 on the housing 12. That is, the tip 17 of the skeg is placed in the inverted "V" tip retaining means and the attachment 30 is pulled upwardly until the skeg is seated in the retainer. The attachment is then automatically in position to be releasably secured to the housing.

Means are also provided for connecting a lower portion of the pair of outer plate-like components 110, 112 to the upper end of plate member 32. In this instance the connection at the upper end is made near the top 37 of the spine 36. Shunt rods 70, 70 extend from a connection area 72 on spine 36 down to pads 74, 74 at the lower ends 40, 40 of components 110, 112. The pads 74, 74 are connected by bolts or other suitable means.

The rods 70, 70 strengthen and maintain the structural integrity of components 110, 112, and enable the use of a material for the apparatus that is thinner and therefore lighter, making the attachment easier to lift and handle.

Further, the rods make it possible to form the plate not only from a metal, such as stainless steel, but also from material such as reinforced plastic. If plastic is used, it would be possible to form the leading edge receiving means 56 integral with and at the same time the plate 32 is formed, to further reduce the cost and weight of the attachment.

It is advantageous to form the rods 70, 70 to be curved outwardly away from the vertical axis of the attachment. As best seen in FIGS. 2 and 3, the curvature of rods 70 is such that a protective zone is defined forward of propeller 20. Since the rods also extend downwardly, in addition to their outward curvature, swimmers and other objects are shunted or diverted downwardly and outwardly away from propeller 20. This prevents injury to swimmers and damage to the propeller.

As a further improvement, curved surface members 80, 82 are positioned between rods 70, 70 and the lower ends 40 and lateral edges 38, 38 of plate 32. (Best seen in FIGS. 1, 2 and 3.) Each of the curved surfaces open toward the forward side of the plate member 32, or the direction of travel when under way. Thus, they are able to intercept and prevent appendages and other body parts from reaching the propeller 20, or lodging or wedging in the intersections of the lower ends of rods 70, 70 and plate member 32. If wedging occurs, the swimmer's body part might not reach the propeller, but the swimmer could be held under water until drowned.

The curved surface members 80, 82 may be formed from rods, preferably rounded, as shown in the drawings. They may also be formed from plastic, for example as a component that is substantially triangular, and which fits in the acute angle area between an intersecting rod and plate member. A curved surface would be formed in a U-shape which opens forwardly.

The lateral edges 38, 38 are preferably flared over as best seen in FIG. 1. This provides a rounded surface along each edge to prevent or reduce cutting or tearing damage to bodily parts contacting the edges.

A releasable securing means is generally indicated at 90 in FIG. 1. The means 90 includes a length of material 92 having elastic properties, such as bungee cord. Spring clips 98 on the ends of cord 92 connect to an eyelet 94 or are otherwise fastened to the upper part of the attachment 30.

As noted hereinbefore, the skeg tip 17 is inserted into the inverted "V" 62, the attachment 30 pivoted into the leading edge receiving means 56, and the attachment pulled up to set the skeg tip in the engaging means 62. The top of the attachment is now in a position to be releasably secured to the housing. The spring clips 98 are pulled around the housing 12 and the cord 92 is stretched so that spring clips 98 can be connected to the spine 36. This arrangement has the advantage of acting as a shock absorber because the cord 92 will stretch in response to contact with an object in the water, but will pull the attachment 30 back into operative position after that contact.

A means for securing the attachment to a boat to prevent loss thereof during any change is illustrated in FIG. 1. One end of a tether 102 is secured to the eyelet or ring 104 on the attachment, while the other end of the tether 102 carries a spring clip 103 which may be selectively connected to a suitable fastener on the boat.

Turning now to the structural differences between applicant's invention in the above-referenced U.S. Pat. No. 5,344,346 and the present invention, we see that the previous plate member was a solid plate that successfully accomplished it's objectives. However, as also noted hereinbefore, it was desirable to remove that solid plate attachment when outside of speed-restricted waters.

It is desirable to admit more water directly to the propeller area to improve propeller efficiency, but it is also desirable to retain the stern lifting properties of applicant's prior invention. In FIGS. 1 through 5, this is accomplished by providing a plate member 32 which depends downwardly and rearwardly as did applicant's previous invention. To admit adequate water to improve propeller efficiency, aperture means 106, 108 are formed in plate member 32 for defining a plurality of separate components 110, 112 and 114 having plate-like forward surfaces. The apertures 106, 108 admit more water to the lower half of the propeller area which was more shielded in the prior invention with a solid plate member. This balances the volume of water delivered to the top half of the propeller area above the plate member and past the housing, both in the prior invention and the present invention. The water flow to the two halves of the propeller area is now balanced and vastly improves the efficiency of the propeller because there is less cavitation and turbulence.

On the other hand, the forward surfaces of the plate-like components 110, 112 and 114 react to the passage of water when the boat is under way to urge the boat's stern upwardly toward a more efficient operating position.

The aperture means may include at least two apertures 106, 108 to define a pair of outer components 110, 112 and a third component 114 depending from the upper portion 116 of the plate member. The forward surface of upper portion 116 also assists in urging the boat's stern upwardly. In this embodiment, the apertures 106, 108 are preferably elongated openings which extend upwardly and forwardly from the trailing lower end of the plate member.

The openings may be left open as shown in FIG. 1 to define a plurality of separated plate-like components having lower ends 118. To prevent entry of swimmer's body parts, objects, sea grass and the like between the plate-like components and possible contact with the propeller, means 120 may be extended between the lower ends 118. This may be wire, cable, coated cable, mesh, grids or other suitable elements depending upon the environment in which the apparatus is operating and the objects that may be encountered.

Alternatively, the lower portion of the plate member 32 may be divided into a plurality of spaced components 110, 112 and 114 having plate-like forward surfaces and defining passageways 106, 108 therebetween to enable water to flow therethrough for more efficient operation of the propeller, while the plate-like forward surfaces assist in urging the stern upwardly, as described above. The spaced components may include a pair of outer components 110, 112 and a third component 114.

In both of the above-noted approaches a rib means 126 may be formed on the forward surface of the third component and extending therealong for reinforcing the third component. The thickness of the rib means 126 may be decreased as at 128 toward the lower end of the third component.

The plate member 32 of this embodiment is substantially planar with the plurality of plate-like components being substantially co-planar. However, the teachings herein are applicable to other shapes, such as the arcuate plate member disclosed in the above-referenced U.S. Pat. No. 5,344,346. Similarly, the size and shape of the openings or passages in the plate member may be modified for the most efficient operation with specific lines of boats and/or propulsion units.

It should also be noted that while this embodiment is shown as releasably secured as an attachment to a driveshaft housing, the apparatus may be permanently secured to a propulsion unit.

Figure 6:
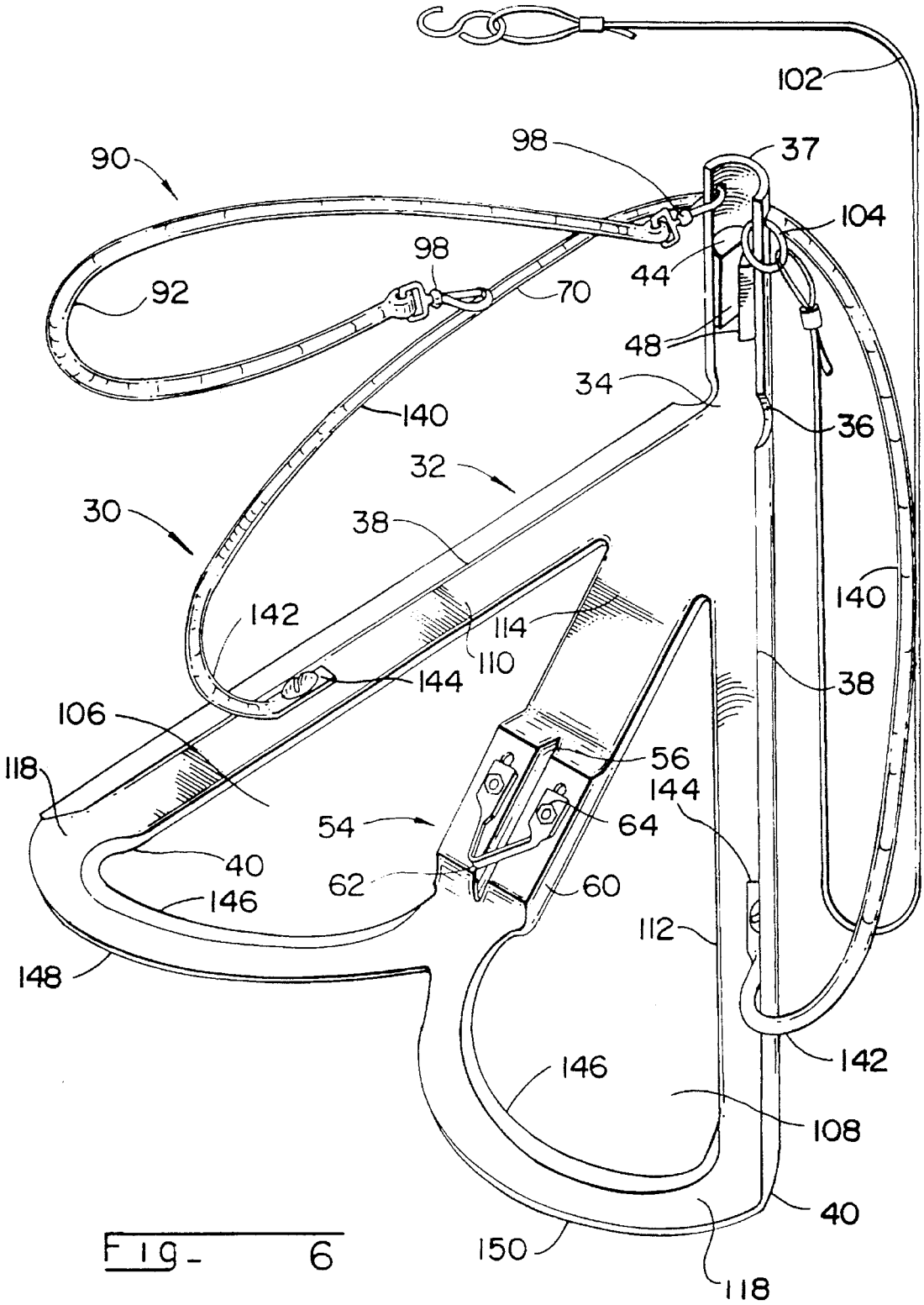
FIG. 6 is a view in perspective of a second embodiment of this invention.

Referring now to FIG. 6, there is illustrated a second embodiment of this invention. While many components are similar to those in the first embodiment and have similar or identical functions, there are illustrated alternate approaches. Those components that are the same as those in FIGS. 1 to 5 have been given the same reference number.

First, the shunt rods 140 have a different configuration at the lower ends thereof. Instead of the split form shown in FIG. 1, where the lower ends of rods 140 terminate at the lower ends 40 of the plate-like components, the rods are curved back in at 142 to provide curved surface members which open toward the forward side of the plate member 32. Thus, the curved surfaces 142 prevent appendages, etc. from reaching the propeller or lodging or wedging in an intersection of the rods and lower ends of the components. The curved surfaces 142 terminate in attachment pads or feet 144, which are secured to the outer plate-like components.

Second, the lower ends 40 of the plurality of plate-like components 110, 112 and 114 are connected by plate-like panels 148, 150 extending therebetween. The panels are most suitable for use in areas of heavy sea grass growths in order to protect the sea grass which is environmentally important. The panels flatten the sea grass and hold it away from the propeller, and do not cut off or injure the grass the way the wire or cable 120 in FIG. 1 might do. Similarly, the forward edges 146 of panels 148, 150 may be rounded or otherwise formed to remove any cutting or other edges that may damage flora or fauna. The panels also help prevent entry of flora and fauna into the water passages 106, 108 and contact with a propeller.

It is to be understood that the two embodiments disclosed have been based upon a "generic" propulsion unit with an engine, driveshaft housing and associated propeller in order to illustrate the principles involved. Thus, the specific design may be modified for particular outboard or inboard-outboard or other applicable propulsion units. For example, the dimension of the plate member may be modified to best achieve the desired design criteria of protecting swimmers and propeller, while achieving the most efficient operation of the propulsion unit.

With respect to both of the embodiments disclosed herein, the plate member depends downwardly and rearwardly to terminate in a trailing lower end. The upper end is preferably relatively narrow, advantageously no wider than the housing. This narrowness preferably commences below the propeller gear housing, and preferably does not exceed the width of the housing in any upward extension, such as the spine extensions described herein.

The tapering outwardly from that lower portion of the upper end is such that preferably no more than 90 degrees of a cylinder, generated by a circle scribed by the tips of the propeller blades as the propeller moves through the water is obscured. The most advantageous scope of taper is approximately 75 degrees, as best seen in FIG. 3, between the outer or lateral edges of the trailing end or edge. This allows the maximum volume of relatively non-turbulent water in the upper half of the propeller area, along with the volume of water through the apertures or passages, to reach the propeller, while providing sufficient lower surface area to react with water passage to lift the stern of the boat.

While the above-noted plate member configuration is the most desirable from the standpoint of attaining maximum non-turbulent water flow to the propeller and attaining the desired lift, it is also desirable to provide additional protection for swimmers. This is provided by the shunt rods, which are curved outwardly away from the vertical axis of the attachment to define a protection zone (as best seen in FIG. 3) for swimmers that substantially covers the propeller turning circle. It is not necessary that the shunt rods be outside of the propeller circle, because in addition to curving outwardly the shunt rods extend downwardly, so that when an object encounters the shunt rods it is diverted outwardly and downwardly away from the propeller. Finally since there are only two shunt rods having relatively small diameters or thicknesses, and since they are located in the outer area of the circle scribed by the propeller, there is very little turbulence generated that would interfere with the efficiency of operation of the propeller.

Therefore, while the choice of the specific components and their arrangement in the preferred embodiments described herein illustrated the results and advantages obtained by the choice of those specific components over the prior art, the invention is not limited to those components and their arrangement. Thus, the forms of the invention shown and described are to be taken as illustrative, and changes in the components or their arrangement may be made without departing from the spirit and scope of this invention. There has been disclosed apparatus which differs structurally from, provides functions not performed by, and has clear advantages over the prior art.

I claim:

1. Apparatus for a driveshaft housing of a boat propulsion unit for protecting swimming creatures, sea grass and the like in the water from the housing and associated propeller and for protecting the housing and the propeller from objects in the water, while improving the efficiency of the propulsion unit, comprising;

(a) a plate member having an upper end adapted to be positioned forward of a housing and to depend downwardly and rearwardly to terminate in a trailing lower end, said plate member tapering outwardly along lateral edges from said upper end to said lower end to divert swimmers and the like around and under a housing and propeller, said downward and rearward configuration of said plate member reacting to the passage of water when under way to urge a boat's stern upwardly toward a more efficient operating position, (b) a lower portion of said plate member having aperture means formed therein for defining a plurality of separate plate-like components having forward plate-like surfaces, said aperture means permitting passage of water therethrough for more efficient operation of a propeller while said forward plate-like surfaces of said plate-like components react to the passage of water when under way to assist in urging a boat's stern upwardly, and (c) means for securing said plate member to a driveshaft housing.

2. Apparatus as defined in claim 1 in which said plurality of separate plate-like components include an outer pair of said components depending from an upper portion of said plate member, said outer pair having said tapered lateral edges formed thereon.

3. Apparatus as defined in claim 2 which further includes means for connecting a lower portion of each of said outer components to said upper end of said plate member for strengthening said outer components, each of said connecting means being curved outwardly from said upper end to define a protection zone whereby swimmer's body parts and other objects are diverted away from a propeller.

4. Apparatus as defined in claim 2 in which said aperture means includes at least two apertures to define a third plate-like component depending from said upper portion of said plate member intermediate said pair of outer components.

5. Apparatus as defined in claim 4 which further includes means cooperating with a skeg and said third plate-like component for maintaining said plate member in alignment with a driveshaft housing.

6. Apparatus as defined in claim 4 in which said apertures are elongated openings extending upwardly and forwardly from said trailing lower end.

7. Apparatus as defined in claim 6 in which said openings are closed by said plate member at said trailing end, thereby deflecting swimmers, objects, sea grass and the like from entry into said openings and contact with a propeller.

8. Apparatus as defined in claim 7 in which said portion of said plate member which closes said openings has a surface formed to assist in urging a boat's stern upwardly.

9. Apparatus as defined in claim 6 in which said openings are open at said trailing end to define a plurality of separated plate-like components depending from an upper portion of said plate member.

10. Apparatus as defined in claim 9 which further includes means extending between lower ends of said separated plate-like components for deflecting entry of swimmers, objects, sea grass and the like away from entry between said plate-like components into contact with a propeller.

11. Apparatus for improving the efficiency of a propulsion unit having a driveshaft housing depending from the stern of a boat while protecting swimmers and the propulsion unit, comprising;

(a) a plate member having an upper end adapted to be positioned forward of a driveshaft housing and to depend downwardly and rearwardly to terminate in a trailing lower end below a propeller, said plate member tapering outwardly along lateral edges from said upper end to said lower end to divert swimmers and objects around and under a housing and a propeller attached thereto, said plate member reacting to the passage of water when under way to urge a boat's stern upwardly toward a more efficient operating position, (b) a lower portion of said plate member being divided into a plurality of spaced plate-like components having forward plate-like surfaces defining passageways therebetween to enable water to flow therethrough for more efficient operation of a propeller while said forward plate-like surfaces of said plate-like components react to the passage of water when under way to assist in urging a boat's stern upwardly.

12. Apparatus as defined in claim 11 in which said spaced plate-like components include a pair of outer plate-like components depending from an upper portion of said plate member, said outer components having said tapered lateral edges formed thereon.

13. Apparatus as defined in claim 12 which further includes a third plate-like component depending from said upper portion of said plate member between said pair of outer plate-like components.

14. Apparatus as defined in claim 13 in which said third plate-like component is positioned to provide alignment of said plate member in cooperation with a skeg of a driveshaft housing.

15. Apparatus as defined in claim 14 in which said third plate-like component has a configuration for receiving a skeg to maintain said third component and thus said plate member in alignment with a driveshaft housing.

16. Apparatus as defined in claim 15 which further includes an inverted "V" member for engaging a trailing surface of a skeg to retain a forward surface of the skeg in said skeg receiving configuration, and means for adjustably securing said inverted "V" member to said third component whereby the position of said inverted "V" member can be adjusted to accomodate skegs of different driveshaft housings.

17. Apparatus as defined in claim 13 in which said third plate-like component has rib means formed on a forward side thereof and extending along said third plate-like component for reinforcing said component.

18. Apparatus as defined in claim 12 which further includes means connecting a lower portion of each of said outer plate-like components to said upper end of said plate member for strengthening said outer components and defining a protection zone whereby appendages or other body parts of creatures and other objects are diverted away from a propeller.

19. Apparatus as defined in claim 12 in which said tapered lateral edges on said outer plate-like components are rounded to remove cutting surfaces.

20. Apparatus as defined in claim 11 which further includes means extending between lower ends of said plate-like components for deflecting swimmers, objects, sea grass and the like away from entry between said plate-like components and contact with a propeller.

* * * * *